US005724739A

United States Patent [19]

Hutton

[11] Patent Number: 5,724,739

[45] Date of Patent: Mar. 10, 1998

[54] SELF-DEFENSE KNIFE

[76] Inventor: D. Patrick Hutton, P.O. Box 339, Kimberling City, Mo. 65686

[21] Appl. No.: 668,727

[22] Filed: Jun. 24, 1996

[51] Int. Cl.[6] ..... B26B 3/00

[52] U.S. Cl. ..... 30/356; 30/340; D22/118

[58] Field of Search ..... 30/340, 336, 346, 30/314; D22/118

[56] References Cited

U.S. PATENT DOCUMENTS

| | | | |
|---|---|---|---|
| D. 234,839 | 4/1975 | Culling et al. | D22/118 |
| D. 320,544 | 10/1991 | Thompson | D22/118 |
| 3,760,438 | 9/1973 | White . | |
| 4,283,854 | 8/1981 | Austin . | |
| 4,802,279 | 2/1989 | Rowe . | |
| 4,941,261 | 7/1990 | Glenn . | |
| 5,197,745 | 3/1993 | Whitely . | |
| 5,400,509 | 3/1995 | Collins . | |

FOREIGN PATENT DOCUMENTS

| | | | |
|---|---|---|---|
| 4015347 | 11/1991 | Germany | 30/356 |

*Primary Examiner*—Douglas D. Watts
*Attorney, Agent, or Firm*—Jonathan A. Bay

[57] ABSTRACT

A self-defense knife has a handle and a blade. A user of the knife preferably holds it by the handle such that the blade extends toward the elbow of the user. The blade has a blunt edge and an opposite sharp edge. The knife is preferably held, more particularly, such that the blunt edge rests against the soft underbelly of the user's forearm. By holding the knife that way, the user is less likely to harm him or herself during use, and is also more likely to maintain the sharp or cutting edge in proper position for fending off an aggressor. The blunt edge is given a shape and arrangement that generally defines a reverse curve of the curve defined by the user's partly flexed wrist and forearm. The curve of the blunt edge thereby closes up a possible gap that could exist between the blunt edge and forearm. That way, an aggressor cannot grab the wrist of the user without also grabbing the sharp edge. Also, when the user raises his or her forearm to ward off a punch or the like from the aggressor—which presumptively is a normal reaction for most people—the cutting edge is positioned to catch the punch. The aggressor would thereby be cut and disabled, or at least be deterred from continuing his or her assault on the user. The contact between the blunt edge and forearm also effectively forms a unified mass which acts as a shield for the user from lunges from the aggressor, except that this kind of shield includes an exposed knife edge, the contact between the forearm and blunt edge also thereby giving support to the blade to buck or oppose the momentum of the aggressor's punch, kick or lunge and the like.

4 Claims, 6 Drawing Sheets

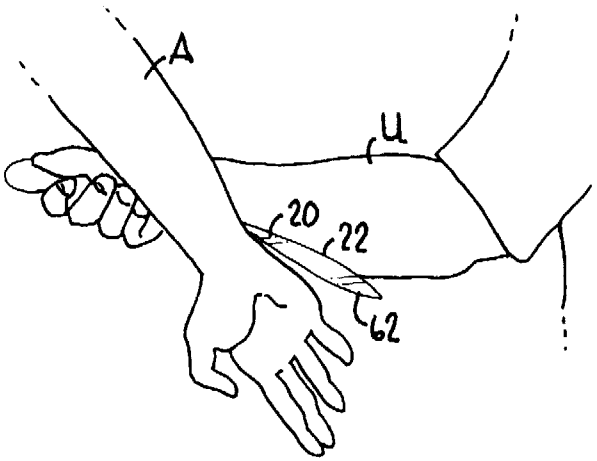
FIG. 7.
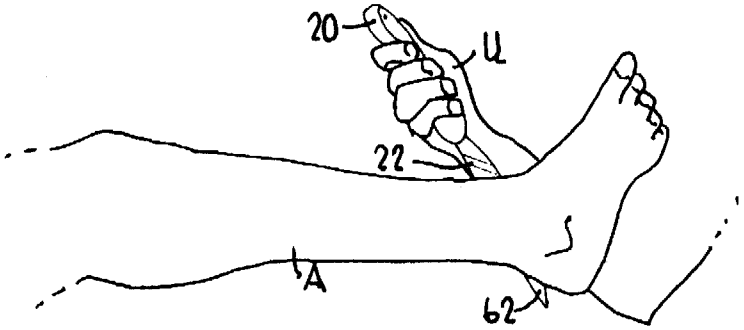
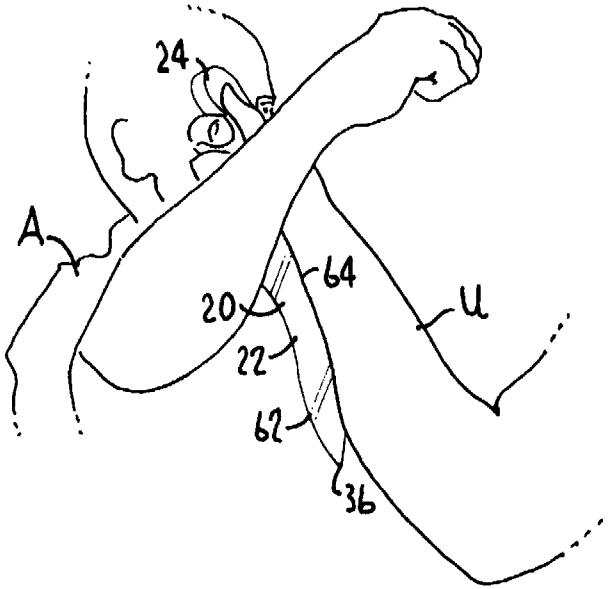
FIG. 6.
FIG. 8.

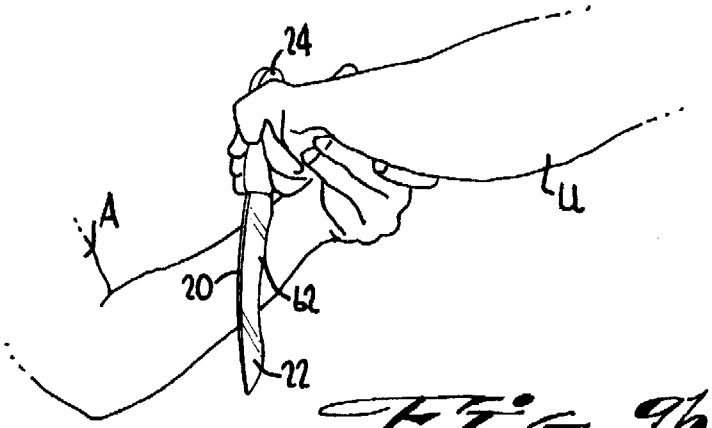
Fig. 9b.
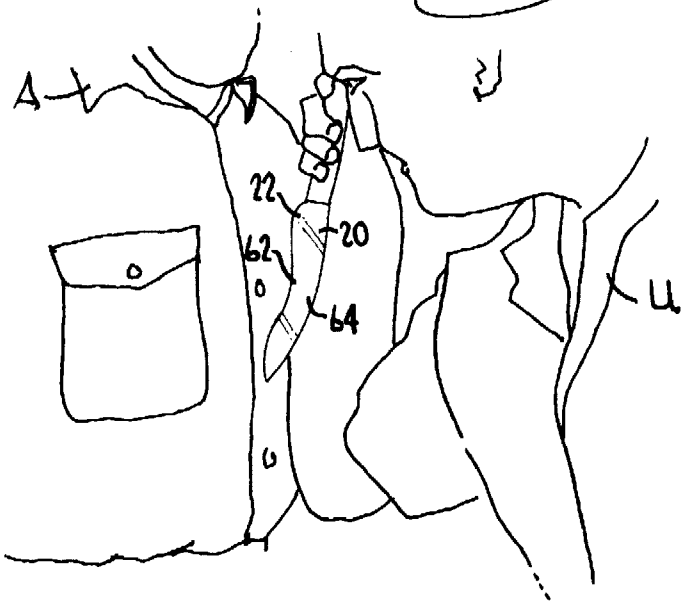
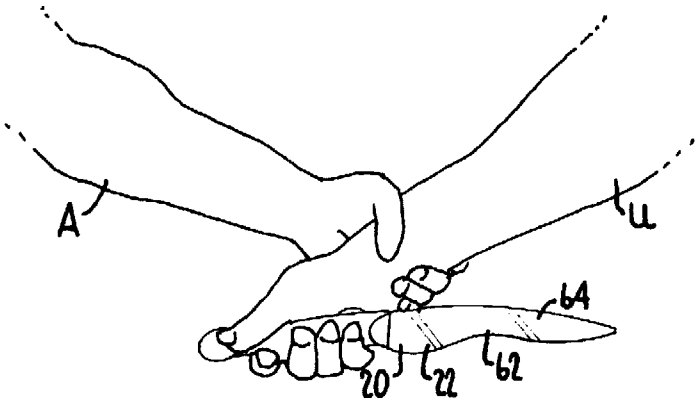
Fig. 9a.
Fig. 10.

SELF-DEFENSE KNIFE

BACKGROUND AND SUMMARY OF THE INVENTION

The invention relates to knives, and more particularly to a self-defense knife.

It is an object of the invention to provide a self-defense knife configured for a user of the knife to defend him or herself from punches, kicks and lunges and like acts of aggression, assaults and battery and so on.

It is an alternate object of the invention that the above knife be configured for handling by the user such that the blade, when the user normally clenches the handle in his or her fist, extends from the fist backwards, as along the user's forearm.

It is an additional object of the invention that the above blade have a blunt edge opposite the sharp or cutting edge thereof, which blunt edge is given a shape to rest against the soft underbelly of the user's forearm so that, the knife is not dangerous to the user and is supported by the forearm in proper position.

It is another object of the invention that the above knife be normally held so that when the user reacts normally to an incoming punch or lunge from an aggressor—i.e., as by raising his or her forearm to ward off the blow—the user's forearm effectively supports and orients the cutting edge in position to catch the punch or lunge and thereby wound and disable the aggressor or deter a return sally.

It is a further object of the invention that the knife have a handle grooved and formed with a reverse impression of the user's clenched fist to give the user a firmer grasp of the handle and thereby ensure proper orientation of the blade and prevent unwanted twisting or malalignment of the blade during use.

These and other aspects and objects are provided according to the invention in a self-defense knife that has a blade and a handle. The blade extends axially from the handle between a sharp edge and a spaced blunt edge. These two edges merge together away from the handle to form a tip end.

The blunt edge of the blade is shaped and arranged to define a curve like, for example and without limitation, a convex arc. The handle and the curve of the blunt edge are cooperatively shaped and arranged for a given user such that, when the handle is gripped in the fist of the user—with the tip end extending in the direction toward the user's elbow—the curve of the blunt edge is proportionately curved to rest against and be given support from the soft underbelly of the user's forearm and wrist. That way, the sharp edge is thereby exposed to incoming punches or lunges and the like from an aggressor when the user's forearm is raised for blocking the punches and the like. The sharp edge thus will cut the aggressor and so effectively disable the aggressor or else deter a return sally.

The handle has a butt end opposite the tip end of the blade. Part of the handle defines a spine portion that extends generally between the butt end and blade. This spine portion aligns generally as a continuation in the handle of the blunt edge of the blade. In this spine portion there is a depression at or near the butt end, as positioned for the pad of the extended thumb of the user to rest therein.

The handle further includes a series of spiral ribs extending circumferentially from one lateral margin of the spine portion to the opposite lateral margin thereof. These ribs define interspaces or troughs which allow the curled fingers of the user to rest therein when the knife is clenched in the fist of the user. Put differently, the spiral ribs give the handle a reverse impression of the clenched fist of the user to provide better grasping.

Given the foregoing arrangement, the spine portion and spiral ribs are shaped and arranged to allow the user to clench the handle stably to prevent the handle twisting in the grip of the user during use.

The handle can be produced in configurations for right-handed or left-handed use, as desired. The blade and handle can be produced either fixed or folding, also as desired. A folding version of the knife preferably includes means to lock the blade relative to the handles, as is well-known in the art.

The curve of the blunt edge is further arranged so that the knife can be comfortably held by the user in a position in which the blunt edge closes up all of any gap that might occur between the blunt edge and the user's forearm. Such a curve includes without limitation a convex-arc shape which defines a reverse curve of the curve defined by the user's partly flexed wrist and forearm. The sharp edge is optionally formed with a concave-arc shape which partly tracks or mimics the convex-arc shape of the blunt edge.

The blade can optionally be sized and proportioned such that, while the knife is clenched in the fist of the user, the blade extends from a point of origin at about the user's wrist, to a point or termination about two-thirds the distance toward the user's elbow. However, the blade can be produced in shorter or longer lengths as desired.

A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

FIG. 6 is a perspective view showing a user of the knife blocking a punch from an aggressor;

FIG. 7 is a perspective view showing a user of the knife blocking a back-handed slap to the wrist;

FIG. 8 is a perspective view of a user of the knife blocking a kick to the upper body and/or head;

FIGS. 9*a* and 9*b* are perspective views depicting an action sequence wherein:

FIG. 9*a* shows an aggressor with a wrist-hold on the knife-holding hand of the user, and, FIG. 9*b* shows the user maneuvering the knife to break free of the wrist-hold;

FIG. 10 is a perspective view showing a user of the knife defending against a rush by an aggressor;

FIGS. 11*a* through 11*c* are perspective views depicting another action sequence, wherein:

FIG. 11*a* shows a user of the knife extending or thrusting the butt into the chest of an aggressor, FIG. 11*b* depicts the user retracting the knife back after the jab, and, FIG. 11*c* shows a back-handed slash with the knife to the throat of the aggressor;

FIGS. 12*a* through 12*c* depict still another action sequence, wherein:

FIG. 12*a* is a perspective view of a user of the knife from the back of the user, wherein the user is facing an aggressor (not shown) and holds the knife as shown in preparation of twirling his or her whole body three-fourths of turn to gain momentum for a given maneuver with the knife, as shown by the sequence of the next two views, FIG. 12*b* is a perspective view comparable to FIG. 12*a*, except that the user has begun the above-mentioned twirling move, and is about half-way complete, the aggressor being shown for reference purposes of where and how the user should position him or herself relative to the aggressor, and, FIG. 12*c* is an enlarged perspective view from a slightly different vantage point than in FIGS. 12*a* and 12*b*, wherein the above-mentioned twirling move is completed, and the knife tip is thrust into the chest of the aggressor.

DETAILED DESCRIPTION OF THE PREFERRED EMBODIMENTS

Figure 1:
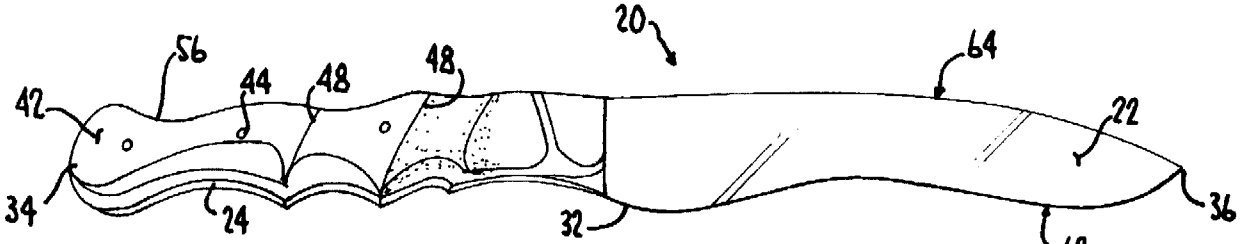
FIG. 1 is a perspective view of a self-defense knife in accordance with the invention.
Figure 2:
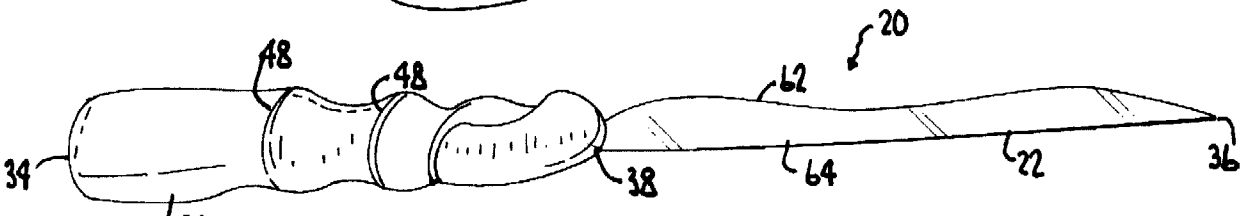
FIG. 2 is a side view thereof.
Figure 3:
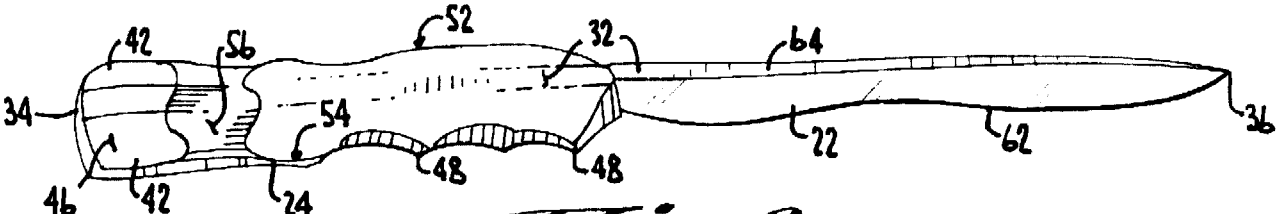
FIG. 3 is a side view from the opposite side thereof.

In FIGS. 1 through 3, a self-defense knife 20 in accordance with the invention comprises a blade 22 and handle 24 attached together. In the drawings, the knife 20 has a fixed handle 24. However, the knife 20 could be arranged with a folding handle as is disclosed by U.S. Pat. No. 5,400,509—Collins, the disclosure of which is fully incorporated herein by this reference thereto. Accordingly, the depiction of a fixed-handle version of the self-defense knife 20 in accordance with the invention is used merely for convenience in this description and does not limit the invention.

The blade 22 is formed from a solid piece 32 of stock of steel. However, the blade 22 can be made from other suitable materials including without limitation moldable resinous and epoxy materials. This stock piece 32 extends axially between a butt end 34 and a tip end 36, and has a shoulder 38 located between the tip and butt ends 36 and 38. The handle 24 is formed partly by that much of the stock piece 32 which extends between the shoulder 38 and butt end 34, and in other part by opposite leaves of wood 42 or a like suitable material affixed to the stock piece 32 by pins or rivets 44 and adhesives or the like. The blade 1 constitutes that much of the stock piece 1 which extends between the shoulder 1 and tip end 1.

Figure 5:
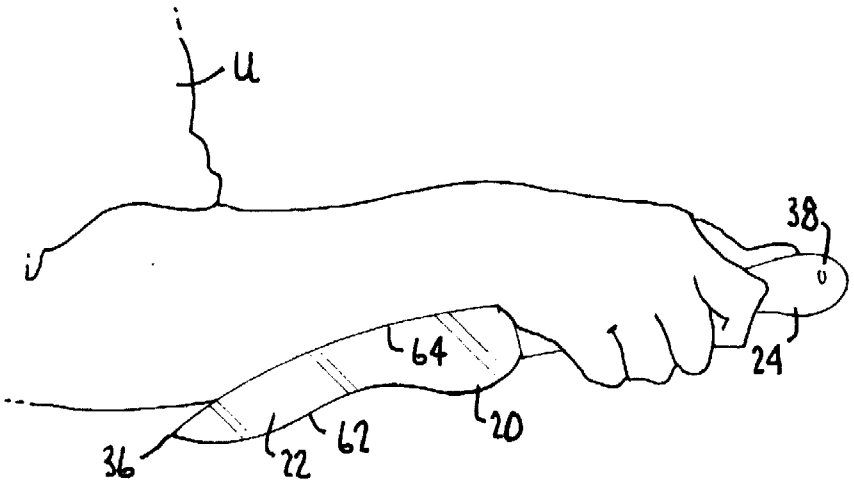
FIG. 5 is a perspective view comparable to FIG. 4 except from a changed vantage point, on the opposite side of the user's arm.
Figure 4:
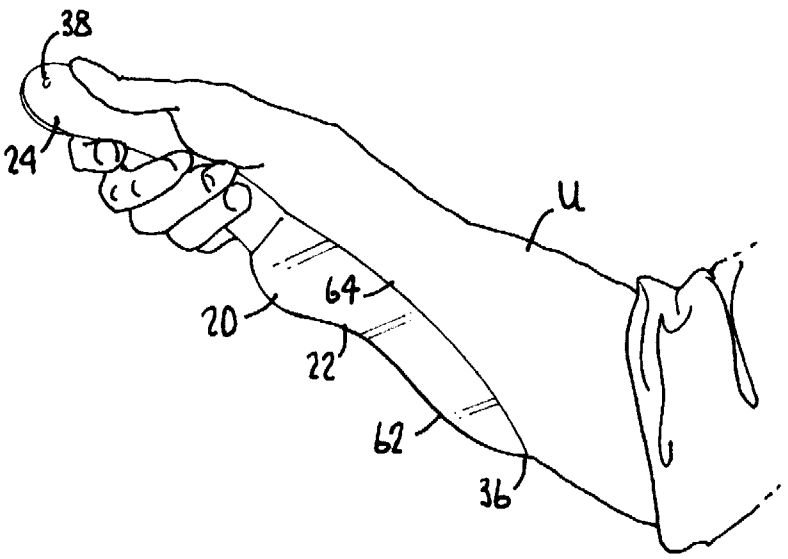
FIG. 4 is a perspective view of the self-defense knife of FIG. 1 showing the preferred manner of how the knife should be gripped in accordance with the invention by a right-handed user thereof.

With brief reference to FIGS. 4 and 5, there is shown the preferred manner how the knife should be held or clenched in a fist of a user U of the knife. With reference back to FIGS. 1 through 3, the knife 20 has various inventive aspects associated with how it is supposed to be held as shown by FIGS. 4 and 5, as well as how it supposed to be used, some exemplary uses of which are shown by FIGS. 6 though 12*c*.

As shown by FIGS. 1 through 3, the handle 24 has a spine portion 46 and a series of partly spiraling ribs 48 extending circumferentially around the handle 24 from one lateral margin 52 of the spine portion 46 to an opposite lateral margin 54 thereof. The spine portion 46 includes a shallow depression 56, near the butt end 34, which defines a resting place for the pad of the extended thumb of the user (see, e.g., FIGS. 4 and 5). The interspaces or troughs between the spirally extending ribs 48 define resting places for the curled fingers of the user U, as also shown by FIGS. 4 and 5. Given the foregoing arrangement of the handle 24, an inventive aspect of the knife in accordance with the invention includes the configuration and size of the handle 24 as for allowing a user U to normally hold in such an orientation that the tip end 36 of the blade 22 extends in the direction toward the elbow of the user. Whereas the drawings show an embodiment of the knife 20 handle which is configured for a right-handed user, the knife 20 could alternatively be configured for a left-handed user and accordingly a right-handed version of the handle 24 is shown merely for convenience in this description and does not limit the invention.

Another inventive aspect concerns the configuration of the blade 22. The blade 22 is formed with a sharp edge 62 and an opposite blunt edge 64, which two edges 62 and 64 merge at the tip end 36. The blunt edge 64 is given a convex-arc shape so that when the knife 20 is held as illustrated in FIGS. 4 and 5, the blunt edge 64 rests snugly against the soft underbelly of the user U's wrist and forearm. More particularly, the blunt edge 64 is given the convex-arc shape as shown so that the user U can abut the blunt edge 64 firmly against his or her wrist and forearm (as shown by FIGS. 4 and 5), to close up any gap or interspace that would otherwise lie between the blunt edge 64 and wrist/forearm.

FIGS. 4 and 5 show how the user U should preferably grip the handle to correctly hold the knife. The user U grips the handle with a clenched fist, the wrist being slightly rotated inward and slightly flexed (i.e., cured), and the user U's thumb being extended and pointed in the axially opposite direction from his or her elbow.

FIGS. 1 and 4-5 show that the sharp edge 62 is generally given a concave-arc shape. The concave-arc shape partly tracks parallel to the convex-arc shape of the blunt edge 64. This aspect of the blade 22's configuration effectively transforms the soft underbelly of user U's forearm—from a point of origin approximately at the wrist, to a termination point part way to the elbow—into sharp cutting edge, for defensive purposes as described below.

The blade 22 is shown given a length such that it extends about two-thirds the distance of the user U's forearm between the wrist and elbow. However, the blade 22 can be produced in sizes relatively longer and shorter depending on the comfort or intended purposes of a given user, such intended purposes including without limitation, whether the user U would rather have a shorter blade for more convenient portability, and so on. Thus the length of the blade 22 as shown by the drawings is given for convenience in this description and is not limiting.

FIGS. 6 through 12*c* disclose various uses of the self-defense knife 20 in accordance with the invention. Whereas self-defense certainly includes purely passive maneuvers such as merely blocking various thrusts or lunges of an aggressor, self -defense also includes judicious use of pre-emptive strikes so as to bring any aggressive encounter to a safe conclusion for the non-aggressor.

FIG. 6 shows how a user U of the knife 20 positions the knife 20 to block a punch from an aggressor A. The user U is only supposed to react much as normally anyone would to block a punch, i.e., raise one's arm is self-defense. Here, however, the user U's forearm is effectively converted into a wound-inflicting sharp edge in addition to merely being an obstacle to the punch. If the knife 20 has a relatively long blade, the user U does not have to position the blade 22 extra precisely to catch the punch. Optimally, the sharp edge 62 of the blade 22 would inflict wound so deep as to disable the aggressor or deter a return sally. If not for the knife 20, ordinarily, then, the blocking of a punch with a bare forearm would merely obstruct the landing of one punch but do nothing to disable or deter any further aggression.

The knife 20 in accordance with the invention is ideal for giving a user U an effective means to deter aggression. When the user U catches the punch as shown by FIG. 6, the blunt edge 64 is safely abutted against the user U'forearm, with the sharp edge 62 correctly aligned to catch the punch. Upon impact from the punch, the sharp edge 62 is stably maintained in position because the handle gives the user U a firm grasp of the knife 20, so firm that the user U can prevent rotation of the handle and consequent malalignment of the sharp edge 62 via twisting of the knife blade 22 or the like. Otherwise, the aggressor A's forearm might just harmlessly glance off the sharp edge 62 rather than be cut deeply by it.

Since the user U's forearm and the blunt edge 64 of knife 20 are preferably abutted firmly against each other, the knife 20 and user U's arm effectively form a unified mass which in combination buck or resist the momentum of the punch. If, on the other hand, there were a slight gap between the user U's forearm and the blunt edge 64, several problems might result.

The blade 22 would be more susceptible to twisting and thereafter not give the aggressor A the sufficiently cutting contact with the sharp edge 62. Or, the resistance given by the user U's wrist could dampen the cutting action into aggressor A's forearm and there again lessen the effectiveness of the knife 20 as a cutting tool. However, the inventive shape and arrangement of the blade 22 and handle 24 are so configured as to nearly ensure proper handling and positioning during use, as shown in the figures.

FIG. 7 shows another defensive block with the knife 20, in this instance, against a common martial-arts style maneuver that is used to dislodge a knife. In accordance with this maneuver, the aggressor A deploys the top of his her forearm to slap the underbelly of the knife-holder U's forearm. This maneuver is effective against knives held not as shown, but as in a style as for thrusting or jabbing. However, with the self-defense knife 20 in accordance with the invention, the aggressor A's forearm encounters the cutting edge of the knife 20. The user U is shown holding the knife in an effective position to counter and block this back-handed slap, and at the same time inflict a cut into the top of the forearm of the aggressor A.

FIG. 8 shows how a user U holds and positions the knife to block a kick from an aggressor A. Kicking is another popular martial-arts style maneuver for which there is no particularly effective counter-measure against via use of a conventional knife. The knife 20 in accordance with the invention is, unlike conventional knives, effective in defending against a kick. Indeed, the knife transforms the forearm of the user U into a wound-inflicting shield against about any thrust or aggressive action of the aggressor A.

FIGS. 9*a* and 9*b* depict an action sequence. In FIG. 9*a*, the aggressor A has grabbed the wrist of the user U of the knife 20. Ordinarily, the aggressor A should not have been able to grab the wrist of the user U as shown. That is, if the user U had properly maintained the blunt edge 64 of the blade 22 against the soft-underbelly of his or her forearm, then the aggressor A would have found him or herself wrapping his or her fingers around the cutting edge 62 of the knife 20, and so would never been able to hold onto the wrist as shown in FIG. 9*a*. However, it is assumed here that the user U of the knife had momentarily held the knife wrongly, allowing a gap to form between his or her forearm and the blunt edge 64 of the blade 22, which gap thus gave the aggressor A an opportunity to grab the user U's wrist as shown. What the aggressor A hopes to accomplish is to restrain the user U's knife-holding hand while disabling the user U with his or her right hand or by kicks and the like.

However, as shown by FIG. 9*b*, the knife 20 in accordance with the invention gives the user U an effective countermeasure to deploy against such a wrist-lock The user U can twist his or her arm as shown, and then slice the aggressor A's forearm, to thereby free his or her knife-holding hand from the aggressor A's grip.

FIG. 10 shows the user U of the knife defending against an onrush or whole-body lunge by an aggressor A. More particularly, FIG. 10 freezes the action of the aggressor A while he or she is closing in closely upon the user U of the knife. The user U of the knife 20 merely blocks the oncoming aggressor A with an upraised bent arm as shown. This gets the knife blade 22 in position to plunge into the abdomen of the oncoming aggressor A, and thereby neutralize this act of aggression.

Figure 11B:
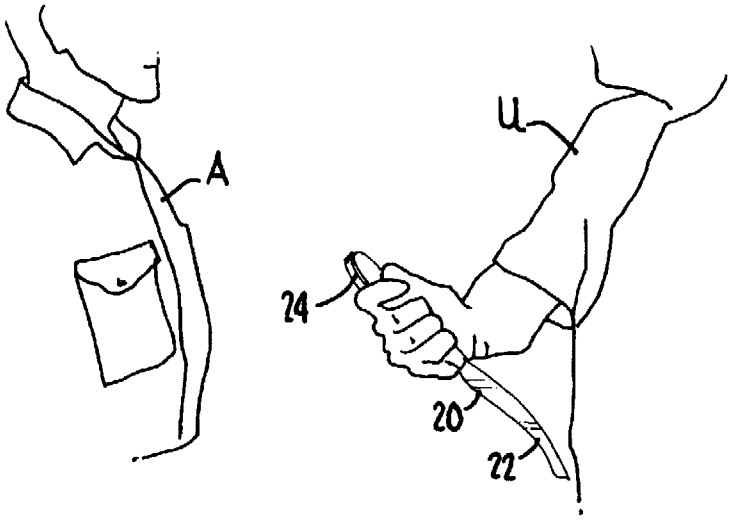
Figure 11A:
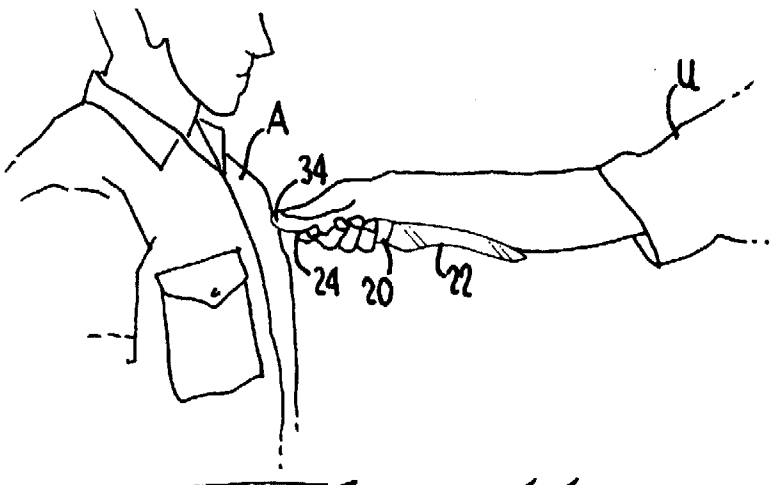
Figure 11C:
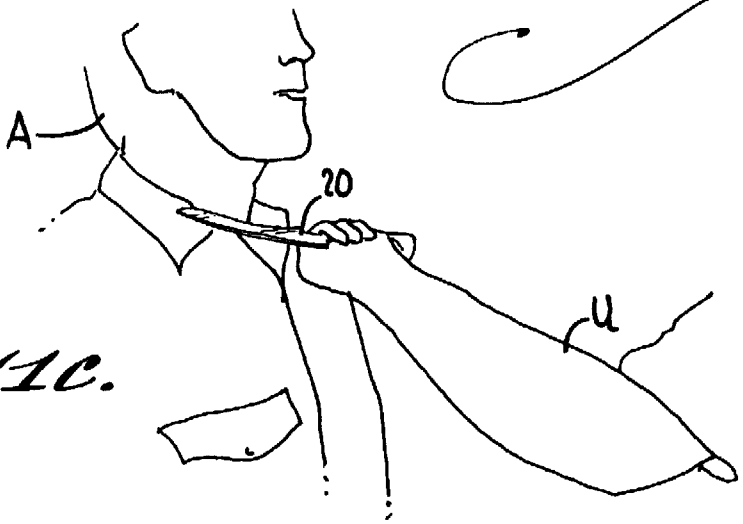

FIGS. 11*a* through 11*c* show another action sequence. Whereas this sequence of actions are initiated and completed by the user U of the knife 20, the purpose of these actions is still self-defense inasmuch as that, a preemptive strike against an aggressor A may be the only practical way a defender can extract him or herself from assault and battery. FIG. 11*a* shows the user U of the knife 20 delivering a jab with the butt 34 of the knife handle 24, into the sternum of the aggressor A. The jab could be landed elsewhere, such as onto the face of the aggressor A and so on. FIG. 11*b* shows that, following the jab in FIG. 11*a*, the user U retracts or withdraws the knife 20 as shown in preparation to deliver a second thrust. Staying in FIG. 11*b*, the user U's right forearm (i.e., the knife-holding hand) is aligned such that the knife 20 in the right hand is held in front of the left side of the user U's body. Next, in FIG. 11*c*, the user U delivers the second thrust, which is a back-handed slash with the cutting edge 62 to the throat of the aggressor A.

Figure 12B:
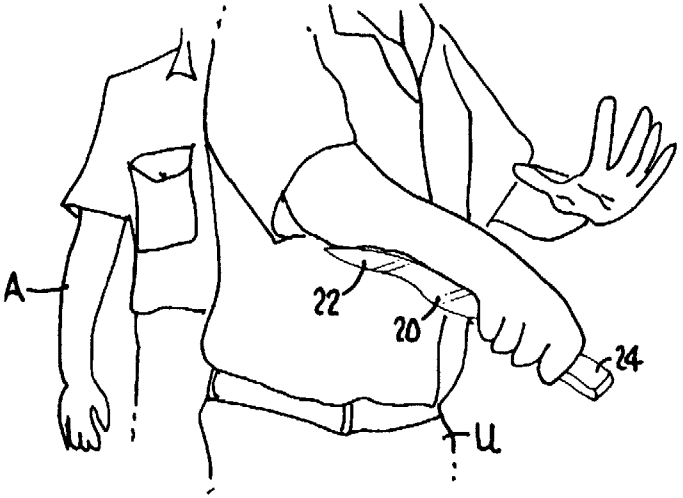
Figure 12C:
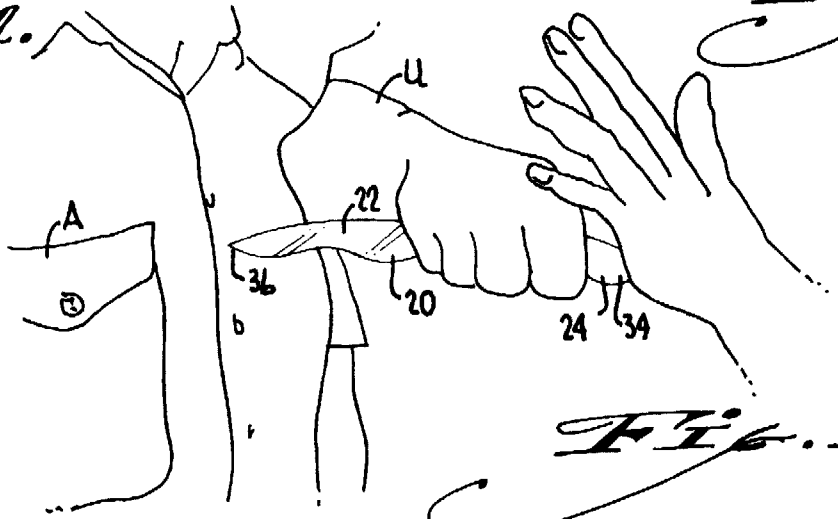
Figure 12A:
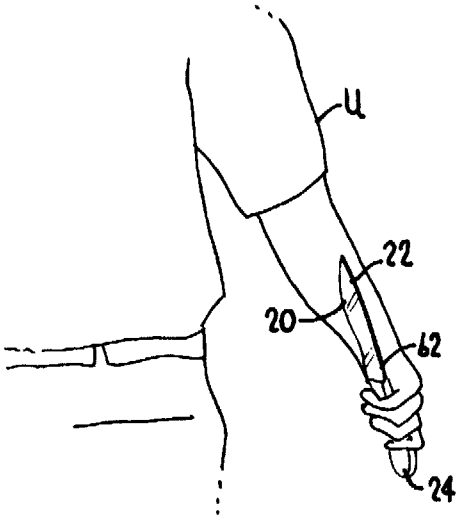

FIGS. 12*a* through 12*c* depict still another action sequence which, like FIGS. 11*a* though 11*c*, show a preemptive strike against an aggressor A, and again for self-defense purposes. FIG. 12*a* depicts the user U of the knife from a vantage point behind the user U. The user U is standing directly facing the aggressor A (who is not shown in FIG. 12*a*, but see FIG. 12*b*). The user U has dropped his or her knife-holding hand down as shown, to prepare for the maneuver shown next. FIG. 12*b* shows the user U in the middle of a clockwise twirl (for a right-handed user) as he or she turns for the purpose of completing about three-fourths of a full turn, to gain momentum for stabbing the tip end 36 into the aggressor A, as shown by FIG. 12*c*. As soon as the user U has gotten the tip end 36 inserted into the abdomen of the aggressor A, the user U next takes his or her left hand and hammers the butt 34 of the handle 24 to drive the blade 22 in deeper. The user U then would twist the blade 22 reversibly clockwise and counterclockwise to pry the wound wider (not shown). Following all that, the user U would then rip downwardly to severely disable the aggressor A from further acts of aggression.

The foregoing uses of the knife 20 in accordance with the invention are, without limitation, just a few examples of how the knife can be deployed for self-defense purposes and are not an exhaustive treatment of the subject. The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A self-defense knife for a user to fend off an aggressor, comprising:

a blade and an attached handle that together lie in substantially the same plane, wherein each of the blade and the handle are shaped to define generally in that plane a curved-ribbon shape, the blade and the handle being attached together in a shallow-V or gull wing shape;

the blade having an inner convex edge, which is blunt, and, a generally opposite outer concave edge which is sharp;

the handle having an inner convex spine which meets the convex blunt edge of the blade at a vertex or cusp of the V- or gull wing shape;

the blade and the handle being given a chosen V- or gull wing shape in adaptation for allowing a user to clench the handle in hand, with the blade extending in the direction of the user's elbow, and with his or her thumb resting on the handle and extended and pointed in the axially opposite direction from his or her elbow, such that if the user slightly rotates and flexes his or her wrist he or she can comfortably rest the blunt edge against his or her wrist, with the heel of his or her palm nested in the vertex or cusp of the V- or gull wing shape, in order that, if the user lifts his or her forearm as to block a kick or a punch from aggressor, then the user shall automatically present the sharp edge at the aggressor and with the blade supported by the wrist in a preferred, proper position;

wherein the combined shapes of the convex blunt edge of the blade, and, the convex spine of the handle, are, cooperatively shaped and proportioned for a given user such that the convex blunt edge, if the knife is held in the preferred proper alignment, extends from its origin in the vertex or cusp of the V- or gull wing shape to rest substantially against the wrist of the given user and hence substantially close up any sizable gap or interspace between itself and the user's wrist or palmar heel, in order to allow the user to deny the aggressor an opportunity to reach fingers into such a gap and undesirably grab the user's wrist.

2. The knife of claim 1, wherein:

the handle has a butt end opposite a tip end of the blade, and the handle includes a spine portion that extends generally between the butt end and blade, and which aligns generally as a continuation in the handle of the blunt edge of the blade; and, the spine portion is formed with a depression that is positioned for the pad of the extended thumb of the user to rest therein;

the handle further includes a series of spiral ribs extending circumferentially from one lateral margin of the spine portion to the opposite lateral margin thereof, which ribs define interspaces or troughs for the curled fingers of the user to rest therein when the knife is clenched in the fist of the user;

the spine portion and spiral ribs being shaped and arranged to allow the user to clench the handle stably to prevent the handle twisting in the grip of the user during use.

3. The knife of claim 2, wherein the spiral ribs are oriented for gripping by one of a right-hand and a left-hand.

4. The knife of claim 1, wherein the blade and handle are attached fixed.

* * * * *